US007591086B2

(12) United States Patent
Sueshige

(10) Patent No.: US 7,591,086 B2
(45) Date of Patent: Sep. 22, 2009

(54) SHOOTER FOR SNOW REMOVER

(75) Inventor: Hiroshi Sueshige, Wako (JP)

(73) Assignee: Honda Motor Co., Ltd., Tokyo ( * ) Notice: Subject to any disclaimer, the term of this patent is extended or adjusted under 35 U.S.C. 154(b) by 446 days.

(21) Appl. No.: 11/493,181

(22) Filed: Jul. 26, 2006

(65) Prior Publication Data

US 2007/0022638 A1 Feb. 1, 2007

(30) Foreign Application Priority Data

Jul. 29, 2005 (JP) ..... 2005-220401

(51) Int. Cl.
*E01H 5/09* (2006.01)
*E05D 5/12* (2006.01)

(52) U.S. Cl. ..... 37/262; 37/260; 16/380

(58) Field of Classification Search ..... 37/260–262; 16/380; 56/13.3, 16.6
See application file for complete search history.

(56) References Cited

U.S. PATENT DOCUMENTS

| | | | | | |
|---|---|---|---|---|---|
| 1,417,563 | A | * | 5/1922 | Phipps | 16/380 |
| 2,442,873 | A | * | 6/1948 | Graham | 220/827 |
| 2,488,601 | A | * | 11/1949 | Mosley et al. | 335/32 |
| 2,538,372 | A | * | 1/1951 | Light | 384/190 |
| 2,590,633 | A | * | 3/1952 | Lucas | 43/42.09 |
| 2,671,236 | A | * | 3/1954 | Richards et al. | 15/119.2 |
| 3,052,372 | A | * | 9/1962 | Shepherd | 16/268 |
| 3,418,683 | A | * | 12/1968 | Stone et al. | 16/335 |
| 4,490,883 | A | * | 1/1985 | Gauron | 16/245 |
| 4,573,239 | A | * | 3/1986 | Valenti et al. | 16/273 |
| 4,759,564 | A | * | 7/1988 | Williams, Jr. | 280/479.3 |
| 4,799,291 | A | * | 1/1989 | Ankum et al. | 16/259 |
| 4,895,042 | A | * | 1/1990 | Wang | 74/519 |
| 5,421,063 | A | * | 6/1995 | Grass | 16/307 |
| 5,477,590 | A | * | 12/1995 | Grabher | 16/297 |
| 6,041,478 | A | * | 3/2000 | Martin | 16/385 |
| 6,568,106 | B2 | * | 5/2003 | Takeuchi | 37/262 |
| 6,860,387 | B2 | * | 3/2005 | Chang | 206/214 |

FOREIGN PATENT DOCUMENTS

| | | | |
|---|---|---|---|
| EP | 372150 | A1 * | 6/1990 |
| JP | 63076025 | | 5/1988 |
| JP | 02038440 | | 2/2002 |

* cited by examiner

*Primary Examiner*—Thomas B Will
*Assistant Examiner*—Abigail A Risic
(74) *Attorney, Agent, or Firm*—Adams & Wilks

(57) ABSTRACT

A shooter for a snow remover has a shooter main body and a shooter guide swingably mounted on the top end of the shooter main body by a hinge. The hinge has an interlocking member for preventing a pin member from falling out from the hinge. The interlocking member is formed from a wire material so as to have elasticity and has pressure parts for applying pressure to both ends of the pin member to retain the pin member in the hinge.

4 Claims, 10 Drawing Sheets

62A
111
109
113
108
68
S
107
66a
66
86
79
106
61
85

SHOOTER FOR SNOW REMOVER

FIELD OF THE INVENTION

The present invention relates to a shooter for a snow remover, and particularly relates to an improvement in a hinge for swingably mounting a shooter guide onto a distal end of a shooter main body.

BACKGROUND OF THE INVENTION

Japanese Utility Model Post-Exam Publication No. 63-076025 discloses a known example of a shooter for a snow remover that includes a shooter main body for ejecting snow collected in an auger in an arbitrary direction; a shooter guide, mounted on the distal end of the shooter main body, for adjusting the angle at which snow is projected; and a hinge member for swingably mounting the shooter guide onto the shooter main body. The hinge member of the shooter is described below with reference to FIG. 10 hereof.

In FIG. 10, a hinge member 211 provided to a shooter 210 is composed of a hinge half 214 that faces a shooter guide 213 from the top end of a shooter main body 212, another hinge half 215 that faces the shooter main body 212 from the bottom end of the shooter guide 213, and a hinge member 216 for rotatably linking the hinge halves 214, 215.

However, if the shooter guide 213 is repeatedly swung in relation to the shooter main body 212, there is a danger that the hinge member 216 will come loose from the hinge halves 214, 215.

The snow to be ejected sometimes leaks out through the gap formed by the hinge halves 214 and 215.

SUMMARY OF THE INVENTION

According to one aspect of the present invention, a shooter for a snow remover is provided which comprises: a shooter main body, adapted to be rotatably mounted on an auger housing of the snow remover, for ejecting to a significant distance snow collected in the auger of the snow remover; and a shooter guide, swingably mounted on the top end of the shooter main body by means of a hinge, for varying the angle of snow projection, wherein the hinge has a hinge half disposed on the side of the shooter main body and mounted on the top end of the shooter main body; a hinge half mounted on the side of the shooter guide and formed on the bottom end of the shooter guide; a pin member that is inserted through the hinge half on the side of the shooter main body and the hinge half on the side of the shooter guide, and that rotatably links the two hinge halves; and an interlocking member for preventing the pin member from falling out from the hinge half on the side of the shooter main body and the hinge half on the side of the shooter guide; and wherein the interlocking member is formed from a wire material, possesses spring properties, and comprises a rectilinear part positioned on the side of the shooter main body or the side of the shooter guide; coiled parts formed at the ends of the rectilinear part; and pressure parts that are formed into a U shape so as to protrude towards the center of the rectilinear part in order for the wire material extending continuously from the ends of the coiled parts to press against the ends of the pin member.

Thus, the hinge has an interlocking member that prevents the pin member from coming loose from the hinge half on the side of the shooter main body and the hinge half on the side of the shooter guide, and the pin member is therefore prevented from becoming misaligned or falling out from the hinge halves. As a result, the shooter for the snow remover can be more simply maintained. The interlocking member is an elastic member formed from a wire material, and pressure is applied by the pressure parts from both sides to the two ends of the pin member. As a result, the interlocking member can be simply mounted on both ends of the pin member by utilizing this elasticity.

It is preferable that the interlocking member further comprise contact parts formed so as to extend further towards the center of the rectilinear part from the end of the wire material that forms the pressure parts so that the contact parts cover a gap formed at the position in which the shooter main body and the shooter guide face each other. Therefore, the snow to be ejected can be prevented from leaking out through the gap. As a result, the operation of removing snow is made more effective.

It is particularly preferable that the contact parts comprise gap filling members for covering the gap. Therefore, snow is prevented from leaking through the gap.

It is preferable that the length of the pin member be less than the combined length of the hinge half on the side of the shooter main body and the hinge half on the side of the shooter guide. Therefore, the pressure parts of the interlocking member can be fitted into the hinge half on the side of the shooter main body or the hinge half on the side of the shooter guide, the pin member can be prevented from falling out, and the interlocking member can be firmly supported on the hinge halves.

BRIEF DESCRIPTION OF THE DRAWINGS

Certain preferred embodiments of the present invention will be described in detail below, by way of example only, with reference to the accompanying drawings, in which.

DETAILED DESCRIPTION OF THE PREFERRED EMBODIMENTS

Figure 1:
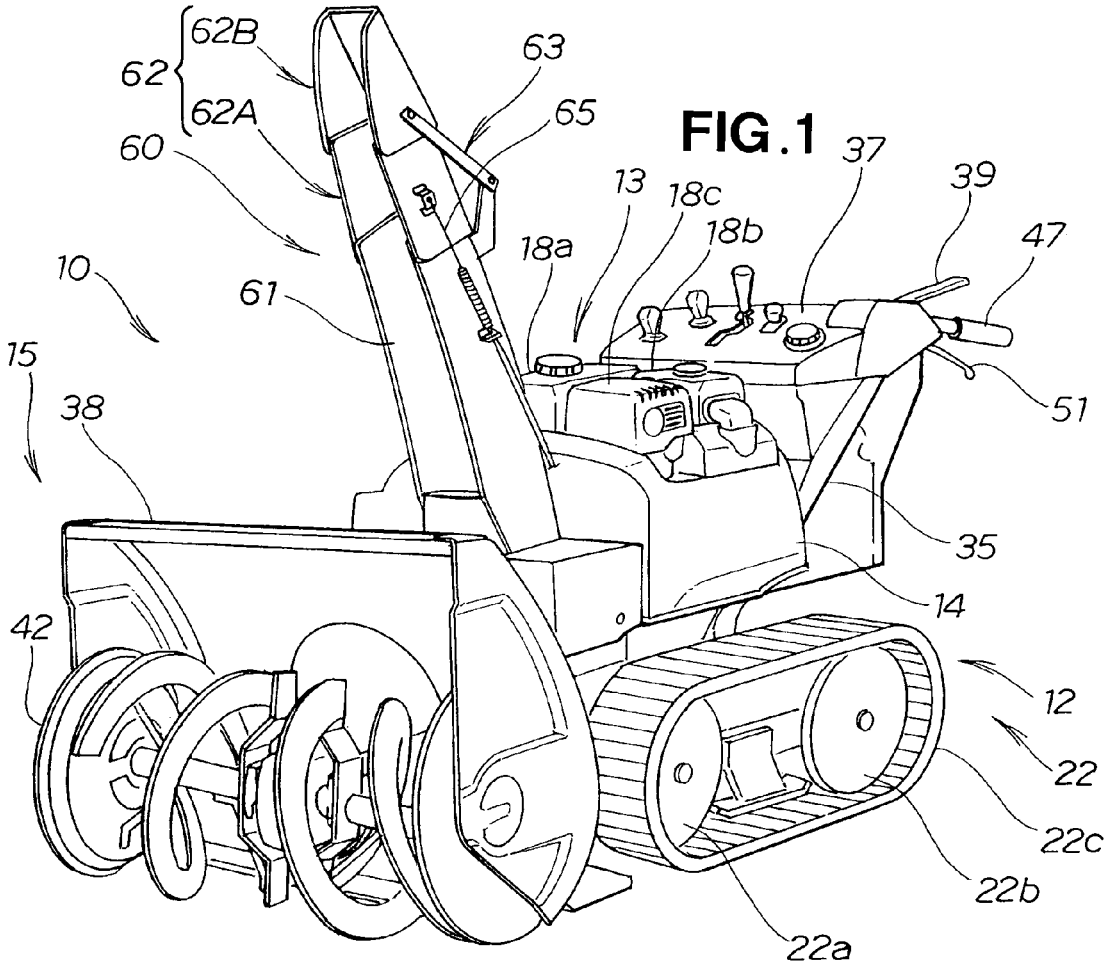
FIG. 1 is a perspective view of a snow remover that has the shooter of the present invention.
Figure 2:
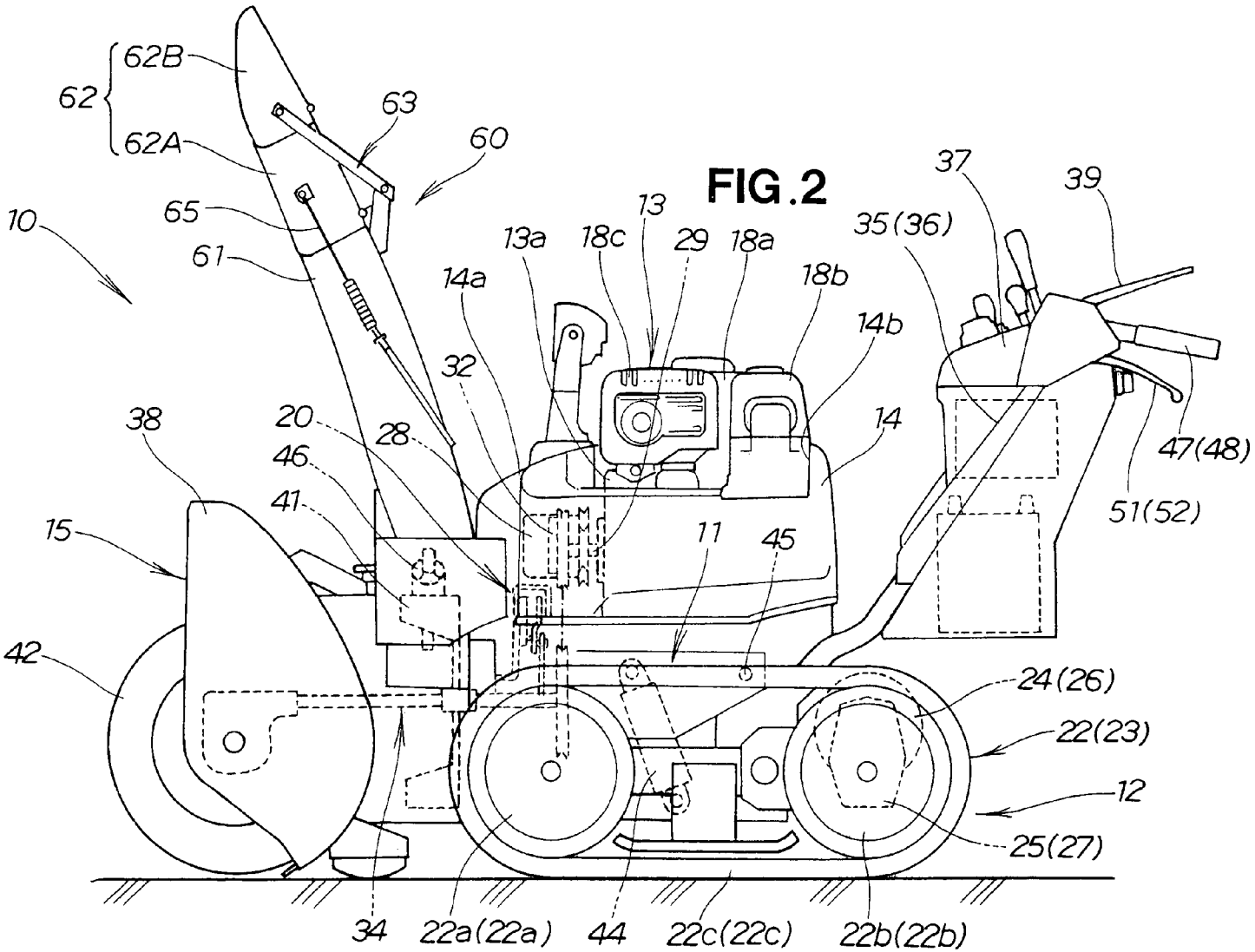
FIG. 2 is a side view of the snow remover shown in FIG. 1.

A snow remover 10 shown in FIGS. 1 and 2 comprises a frame body 11, a propulsion unit 12 provided underneath the frame body, and an engine 13 mounted on the frame body 11. The engine 13 is the drive source of the propulsion unit 12 and is protected by an engine cover 14. A rotary snow-removing unit (snow-removing unit) 15 for collecting snow is provided on the front of the frame body 11, so as to be capable of tilting to the left and right in relation to the frame body 11. The snow collected in the snow-removing unit 15 is ejected by means of a shooter 60 that is rotatably provided on the auger housing 38.

Left and right operating handles 35, 36 extend from the top of the frame body 11 so as to be inclined upward and to the rear. An operating panel 37 is provided between the left and right operating handles 35, 36. The left and right operating handles 35, 36 have left and right grips 47, 48. The snow remover 10 described above is a self-propelled traveling snow remover.

The propulsion unit 12 includes left and right propelled parts 22, 23, left and right electric motors 24, 26, and left and right decelerators 25, 27. The left and right electric motors 24, 26 are driven by electricity from a power generator 28, and the left and right propelled parts 22, 23 are propelled. Therefore, the speed of the left and right propelled parts 22, 23 is regulated by adjusting the rotational speed of the electric motors 24, 26.

The power generator 28 is driven by the engine 13 to generate electricity, and the electricity is fed to the left and right electric motors 24, 26 to drive the motors 24, 26. Therefore, the engine 13 serves as the drive source for the propelled parts 22, 23.

The engine cover 14 is provided on top of the frame body 11. A front end 14*a* of the engine cover 14 extends to the front of the frame body 11. The engine cover 14 has an opening 14*b* formed in the middle thereof through which projects a top part 13*a* of the engine 13. A fuel tank 18*a*, an air cleaner 18*b*, and a muffler 18*c* protrude upward from the opening 14*b*. The front end 14*a* of the engine cover 14 covers a tilt detection means 20 for detecting the tilt of the snow-removing unit 15 to the left and right.

The left propelled part 22 is composed of a front rotating wheel 22*a*, a back driving wheel 22*b*, and a crawler belt 22*c* passed over these two wheels, wherein the driving wheel 22*b* is propelled to rotate forwards and backwards by the left electric motor 24.

The right propelled part 23 is symmetrical to the left propelled part 22, the structural components thereof are denoted by the same numerical symbols, and descriptions thereof are omitted.

An output axle 29 of the engine 13 is coupled with a drive axle 34 via an electromagnetic clutch 32. The drive axle 34 is extended into an auger housing 38 and is coupled with a blower 41 and an auger 42.

The left operating handle 35 has a propulsion-enabling lever 39 and a left-turn lever 51. The propulsion-enabling lever 39 is grasped to allow the snow remover 10 to be propelled, and is released to halt propulsion. The left-turn lever 51 controls the rotation of the left electric motor 24. The right operating handle 36 has a right-turn lever 52 for controlling the rotation of the right electric motor 26.

The snow remover 10 further includes a height-adjustment cylinder 44 for adjusting the height of the snow-removing unit 15 including the auger 42, and a tilting cylinder 46 for tilting the snow-removing unit 15. Electrohydraulic cylinders may, for example, be used as the height-adjustment cylinder 44 and the tilting cylinder 46.

The frame body 11 and the rotary snow-removing unit 15 are caused to swing vertically around a supporting axle 45 by operating the height-adjustment cylinder 44. Specifically, since the rotary snow-removing unit 15 is mounted on the front of the frame body 11, the rotary snow-removing unit 15 is also caused to swing vertically together with the frame body 11 to adjust the height of the rotary snow-removing unit 15. Operating the tilting cylinder 46 causes the rotary snow-removing unit 15 to roll and tilt to the left and right in relation to the frame body 11.

When the snow remover 10 is used to remove snow, the operator grasps the left and right grips 47, 48 with the left and right hands and propels the frame body 11 forward. Snow is collected within the auger 42 while the frame body 11 is moved forward, the collected snow is thrown upward by the blower 41, and the snow thrown upward is projected out by the shooter 60.

Figure 3:
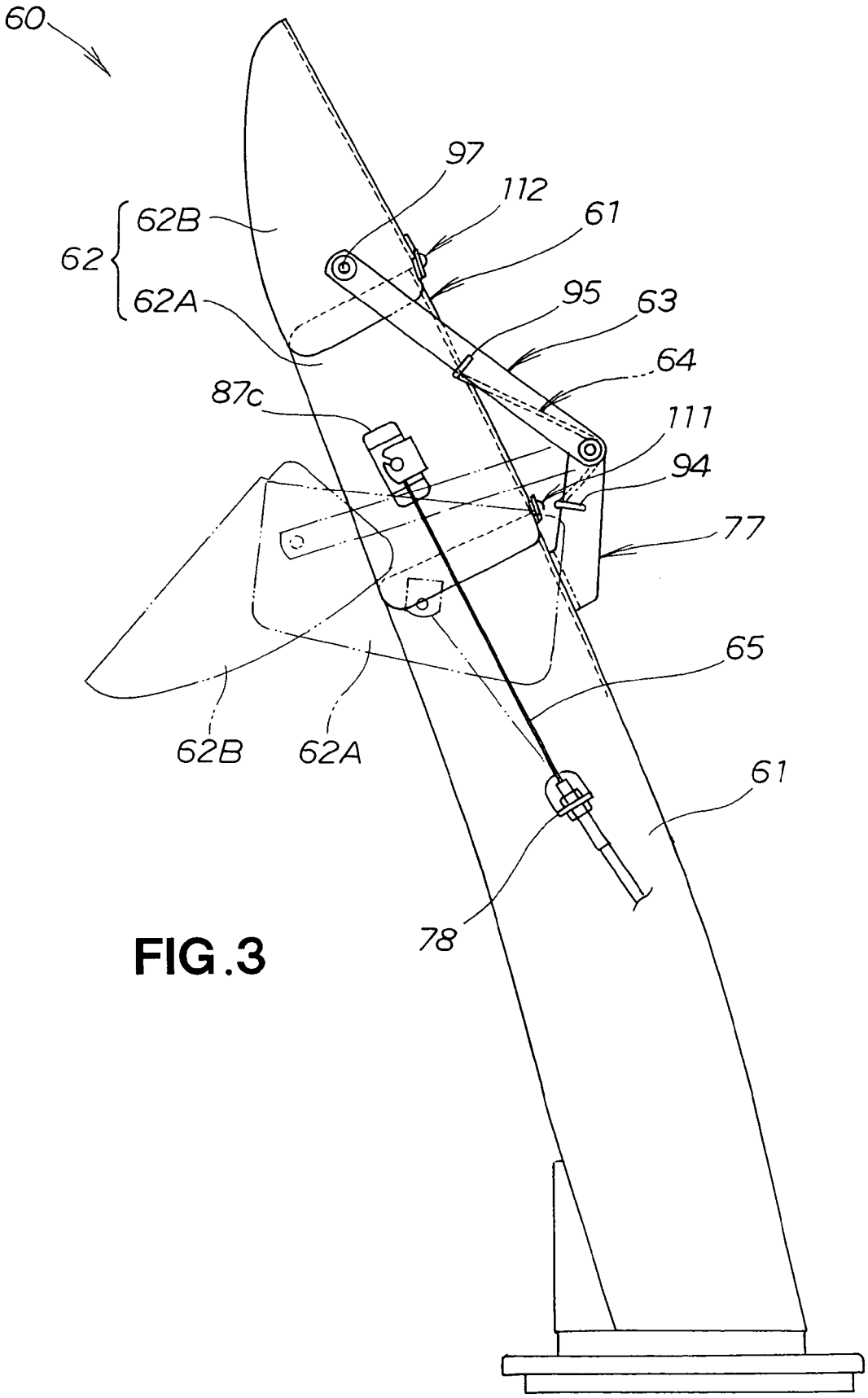
FIG. 3 is an enlarged view of the shooter shown in FIG. 2.
Figure 4:
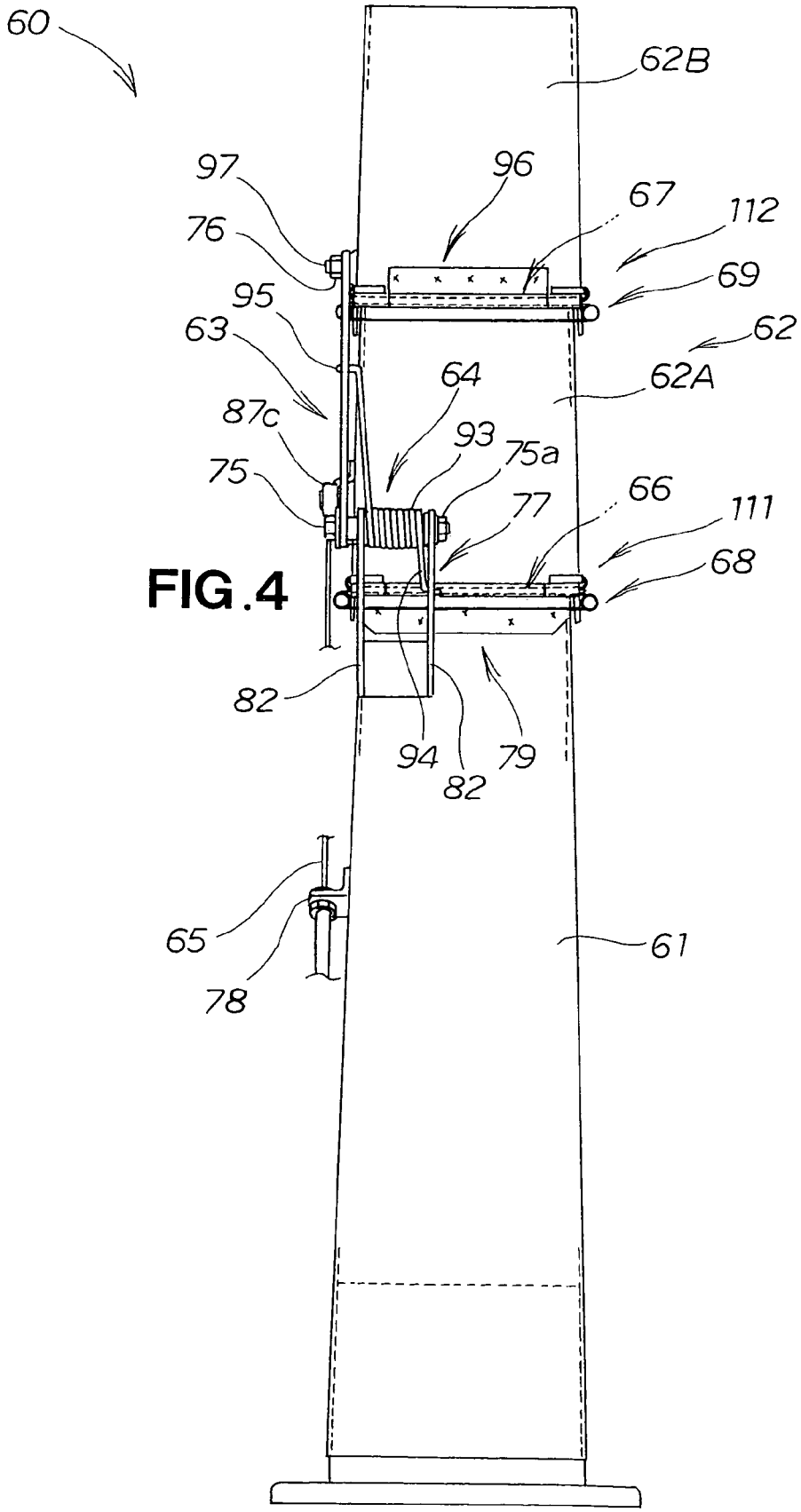
FIG. 4 is a rear view of the shooter shown in FIG. 3.

As shown in FIGS. 3 and 4, the shooter 60 includes a shooter main body 61 rotatably mounted on the top of the auger housing 38 (FIG. 2), and a shooter guide 62 that is swingably mounted on the top end of the shooter main body 61 so as to vary the angle of snow projection. The shooter guide 62 is composed of a first shooter guide 62A that is swingably mounted on the top end of the shooter main body 61, and a second shooter guide 62B that is swingably mounted on the top end of the first shooter guide.

A plate link 63 links the shooter main body 61 and the second shooter guide 62B. A torsion spring 64 is located between the shooter main body 61 and the plate link 63. An operating wire 65 simultaneously operates the first and second shooter guides 62A, 62B by means of the plate link 63.

The shooter guide 62 is configured from the first shooter guide 62A and the second shooter guide 62B. The torsion spring 64 is a member that returns the second shooter guide 62B to its initial position by means of the plate link 63.

Pulling the operating wire 65 causes a downward operating force to act on a mounting unit 87*c* of the first shooter guide 62A on which the distal end of the operating wire 65 is mounted. The first shooter guide 62A rotates around a first hinge 111 in the counterclockwise direction (downward) in FIG. 3. At this time, since the shooter main body 61 and the second shooter guide 62B are both rotatably coupled with the plate link 63, the second shooter guide 62B also rotates downward around a second hinge 112 along with the rotation of the first shooter guide 62A. Therefore, the first and second shooter guides 62A, 62B are curved in relation to the shooter main body 61, as shown by the double-dashed lines.

The shooter 60 is designed so that a bracket 77 is provided near the side of the reverse surface of the shooter main body 61; the plate link 63 is provided on the side surfaces of both the shooter main body 61 and the first and second shooter guides 62A, 62B; the torsion spring 64 located between the bracket 77 and the plate link 63 is disposed near the shooter main body 61; and the operating wire 65 is positioned on the side surfaces of both the shooter main body 61 and the first shooter guide 62A. The area around the shooter main body 61 can therefore be simplified. As a result, the outward appearance of the area around the shooter main body 61 is improved.

Figure 5:
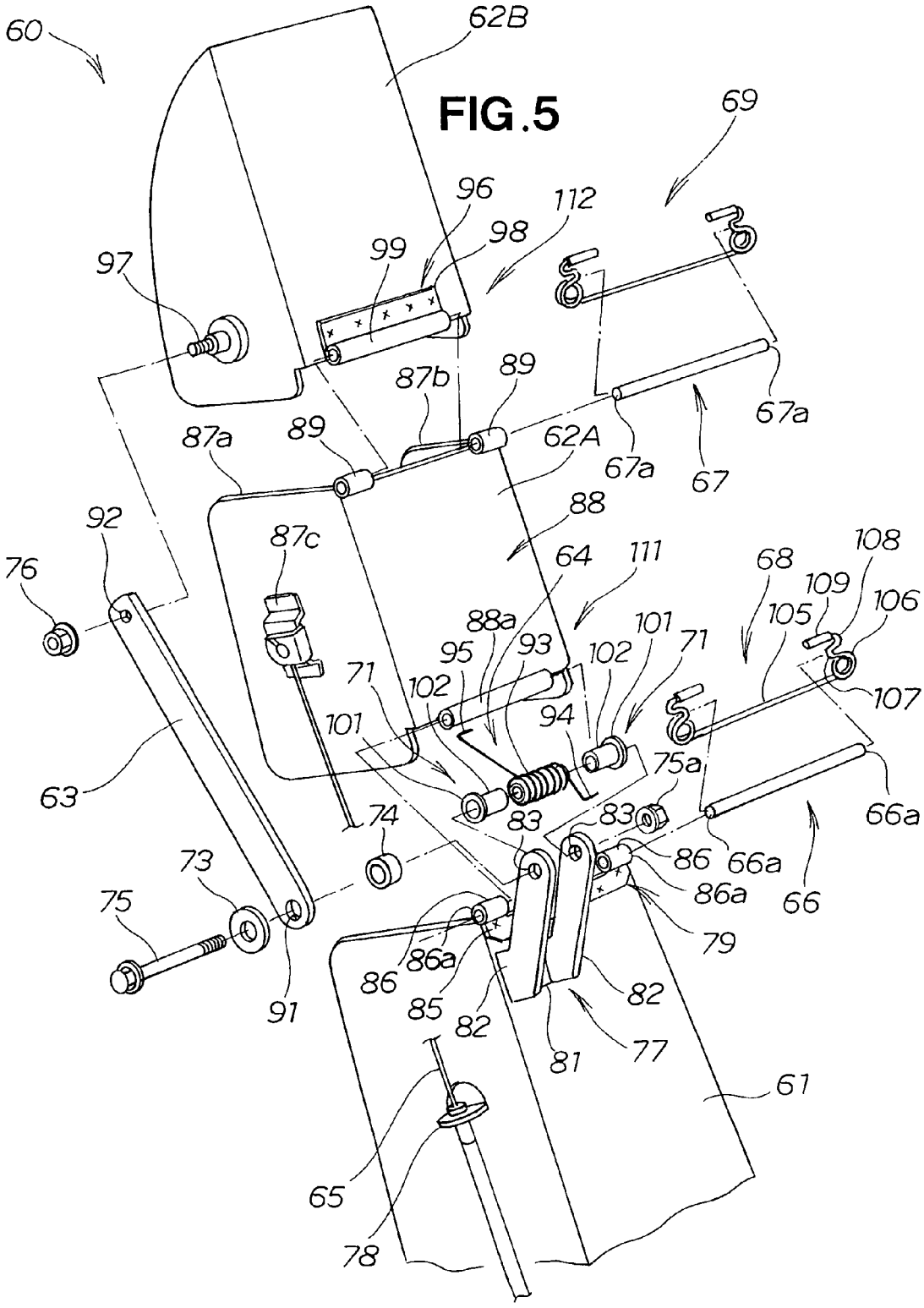
FIG. 5 is an exploded perspective view of a shooter apparatus.

The shooter main body 61 includes a bracket 77, a stay 78, and a hinge half 79 on the side of the shooter main body, as shown in FIG. 5. The bracket 77 supports one end of the plate link 63, and also supports a coil 93 of the torsion spring 64. The stay 78 is formed on the side surface of the shooter main body 61 in order to support the operating wire 65. The hinge half 79 on the side of the shooter main body is mounted on the top end of the shooter main body 61.

The hinge half 79 on the side of the shooter main body is made from a separate member and includes a bonding plate 85 that is spot-welded to the shooter main body 61, and external tubular parts 86, 86 whose top ends are formed so as to curl away from the bonding plate 85 to allow a pin member 66 to be inserted and used to hold an interlocking member 68.

The first shooter guide 62A has the shape of a U in cross section and is composed of a reverse-side plate 88, and left and right side plates 87*a*, 87*b* that are formed to bend around the sides of the reverse-side plate 88.

The reverse-side plate 88 includes a central tubular part 88*a* formed so that the bottom end curls in the middle, and external tubular parts 89, 89 formed so that the top ends are both curled. The central tubular part 88*a* of the reverse-side plate 88 constitutes the hinge half on the side of the shooter guide.

The mounting unit 87*c* for mounting the distal end of the operating wire 65 is located on the side surface of the left side plate 87*a*.

The shooter main body 61 and the first shooter guide 62A are coupled via the pin member 66, the external tubular parts 86, 86, and the central tubular part 88*a*. The interlocking member 68 is set at both ends of the pin member 66, whereby the pin member 66 is prevented from coming loose from the external tubular parts 86, 86 and the central tubular part 88*a*. The interlocking member 68 is engaged with the outer ends 86*a*, 86*a* of the external tubular parts 86, 86.

The second shooter guide 62B is formed into a U shape in cross section and includes a hinge half 96 that is fixed in place in the middle of the bottom end thereof by welding. Furthermore, the second shooter guide 62B has a stud bolt 97 that is provided to the side surface thereof in order to rotatably support the other end of the plate link 63.

The hinge half 96 is composed of a bonding plate 98 that is spot-welded onto the second shooter guide 62B, and a central tubular part 99 formed so as to curl away from the bonding plate 98.

The first and second shooter guides 62A, 62B are coupled via a pin member 67 that is inserted through the external tubular parts 89, 89 and the central tubular part 99. An interlocking member 69 is set at both ends of the pin member 67, whereby the pin member 67 is prevented from coming loose from the external tubular parts 89, 89 and the central tubular part 99.

A bolt through-hole 91 for enabling the plate link to be rotatably mounted on the side of the shooter main body 61 is formed in one end of the plate link 63. A stud through-hole 92 through which the stud bolt 97 is inserted is formed in the other end of the plate link 63. One end of the plate link 63 is rotatably supported on the shooter main body 61 by a bolt 75. The other end is fastened with a nut 76 by passing the stud bolt 97 through the through-hole 92, so that this other end is rotatably supported on the second shooter guide 62B.

Since the first shooter guide 62A and the second shooter guide 62B are moved in conjunction with each other by the plate link 63, it is possible to simultaneously operate the second shooter guide 62B by operating the first shooter guide 62A.

The torsion spring 64 is composed of a coil 93 supported by the bolt 75 via two collars 71, 71; an interlocking part 94 that engages with the bracket 77 of the shooter main body 61; and the other interlocking part 95 that engages with the plate link 63. The torsion spring 64 is located between the shooter main body 61 and the plate link 63 and constantly urges the second shooter guide 62B in the return direction. The coil 93 of the torsion spring 64 allows the collars 71, 71 to be inserted from both ends.

The operating wire 65 is fastened to the first shooter guide 62A at the distal end. The wire extends from the shooter guide 62A through the shooter main body 61 to the side of the frame body 11 (FIG. 2) and operates the first and second shooter guides 62A, 62B.

The collars 71 are formed from a resin or rubber-based material. These collars 71 are composed of a flange 101 that is in contact with the end of the coil 93, and tubular bodies 102 that are inserted into the coil 93. The tubular bodies 102 support the inner periphery of the coil 93. Specifically, the collars 71, 71 are vibration-reducing members that reduce vibration and deformation in the radial direction of the torsion spring 64. The bolt 75 supports the collars 71, 71 by being inserted into the collars 71, 71 via a washer 73, the plate link 63, and a spacer 74. The bolt 75 is fastened with a nut 75*a*.

The bracket 77 is formed into a substantial U shape, and is composed of a bottom part 81 that is spot-welded onto the shooter main body 61, and left- and right-side parts 82, 82 that extend from both ends of the bottom part 81. The left- and right-side parts 82, 82 have through-holes 83, 83 formed to allow the bolt 75 to be inserted.

The first hinge 111 is configured from the hinge half 79 on the side of the shooter main body, the central tubular part 88*a* of the reverse-side plate 88, the pin member 66, and the interlocking member 68. The second hinge 112 is configured from the external tubular parts 89, 89 of the reverse-side plate 88, the hinge half 96, the pin member 67, and the interlocking member 69.

Figure 6:
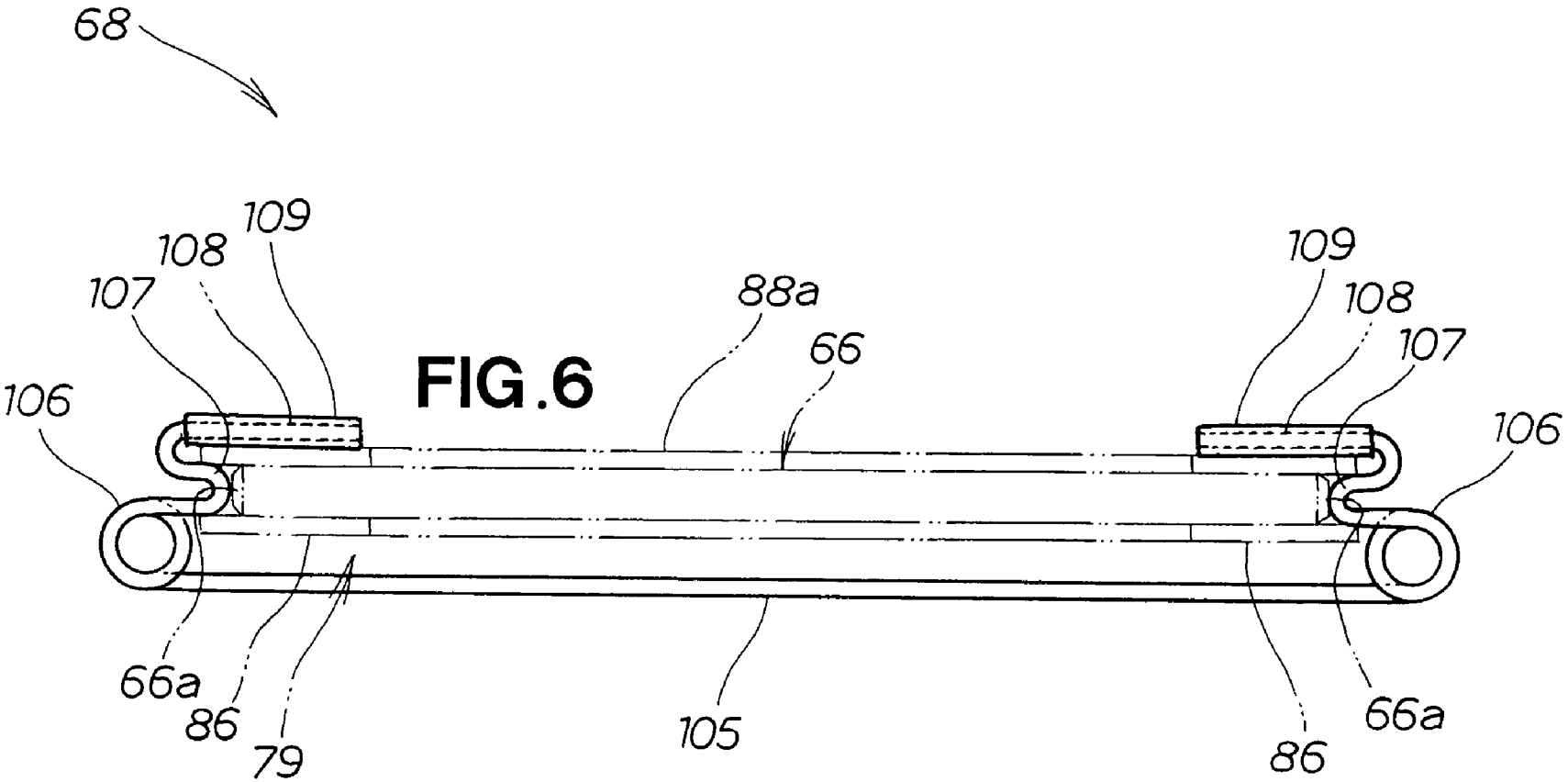
FIG. 6 is a plan view of the interlocking member shown in FIG. 5.

The interlocking member (spring press) 68 is formed of an elastic wire material, as shown in FIG. 6. The interlocking member 68 has a rectilinear part 105 positioned on the side of the shooter main body 61 or the side of the first shooter guide 62A shown in FIG. 5; coils 106, 106 formed at both ends of the rectilinear part 105; pressure parts 107, 107 that apply pressure to the ends 66*a*, 66*a* of the pin member 66, and which are formed by bending the coils 106, 106 into substantial U shapes towards the center of the rectilinear part 105; contact parts 108, 108 that are formed by bending the pressure parts 107, 107 further towards the center of the rectilinear part 105; and tubes 109, 109 that are mounted on the contact parts 108, 108. The pressure parts 107, 107 are engaged with the external tubular parts 86, 86 of the hinge half 79 on the side of the shooter main body.

The pin member 66 is formed to be smaller in length than the external tubular parts 86, 86 of the hinge half 79 on the side of the shooter main body, including the length of the central tubular part 88*a* formed on the first shooter guide 62A shown in FIG. 5. Therefore, the pressure parts 107, 107 of the interlocking member 68 can be embedded into the external tubular parts 86, 86. As a result, the interlocking member 68 prevents the pin member 66 from falling out, and is firmly supported on the hinge half 79 on the side of the shooter main body.

The pin member 66 and the pin member 67 (FIG. 5) are common members. The interlocking member 68 is in contact with the ends 66*a*, 66*a* of the pin member 66. The interlocking member 69 is in contact with the ends 67*a*, 67*a* of the pin member 67. The interlocking member 68 and the interlocking member 69 are also common members.

Figure 7:
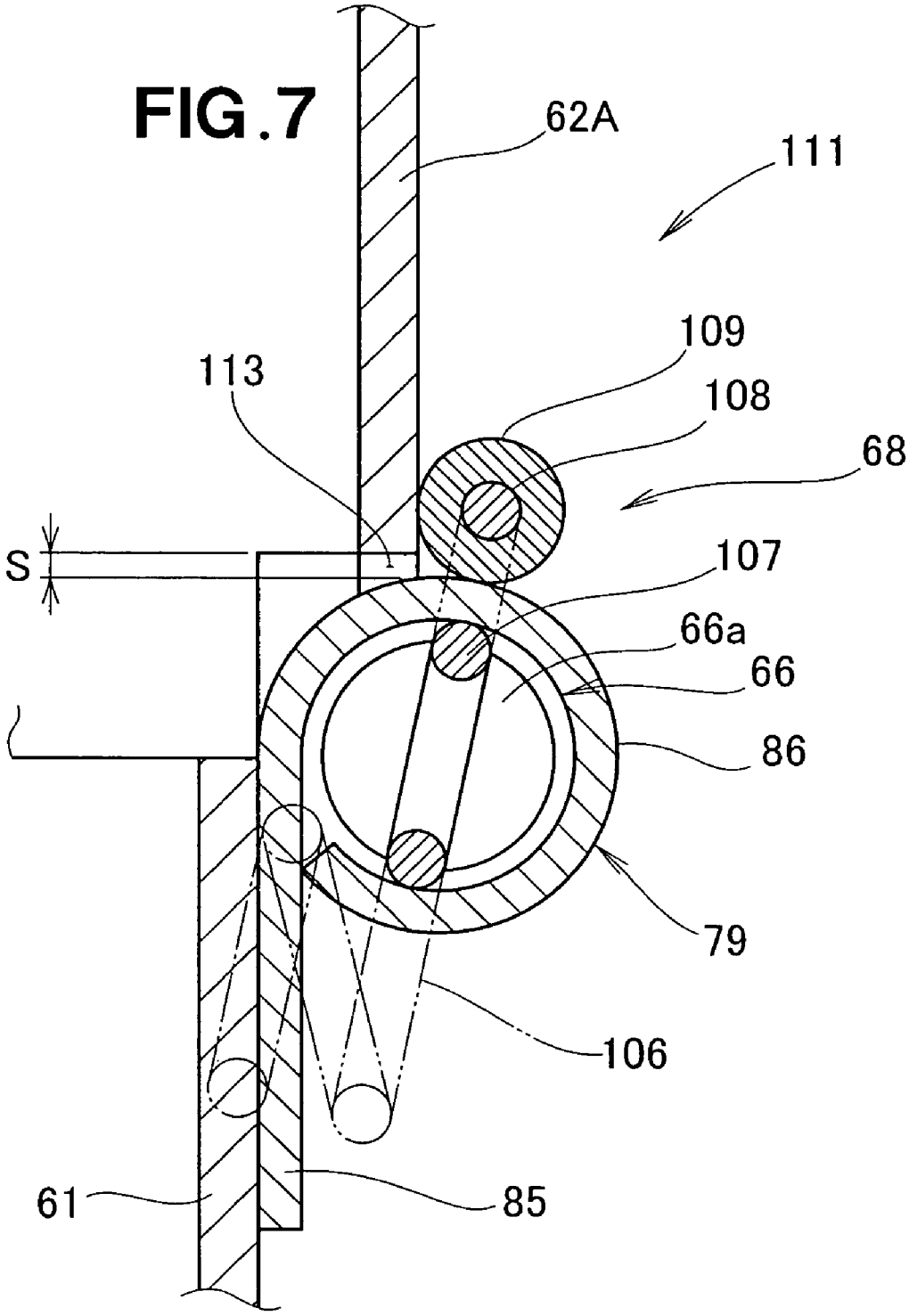
FIG. 7 is a cross-sectional view of a hinge and an interlocking member positioned between the shooter main body and the first shooter guide.

A gap S formed in the connecting surface 113 where the shooter main body 61 and the first shooter guide 62A face each other, i.e., a gap S formed between the hinge half on the side of the shooter main body and the hinge half 88*a* on the side of the shooter guide, is covered by the contact parts 108 of the interlocking member 68 as shown in FIG. 7, whereby the snow to be ejected is prevented from escaping to the exterior through the gap S.

The tubes 109 are preferably mounted on the contact parts 108 because the gap S is then more effectively closed off. Therefore, the tubes 109 function as gap-filling members.

Figure 8:
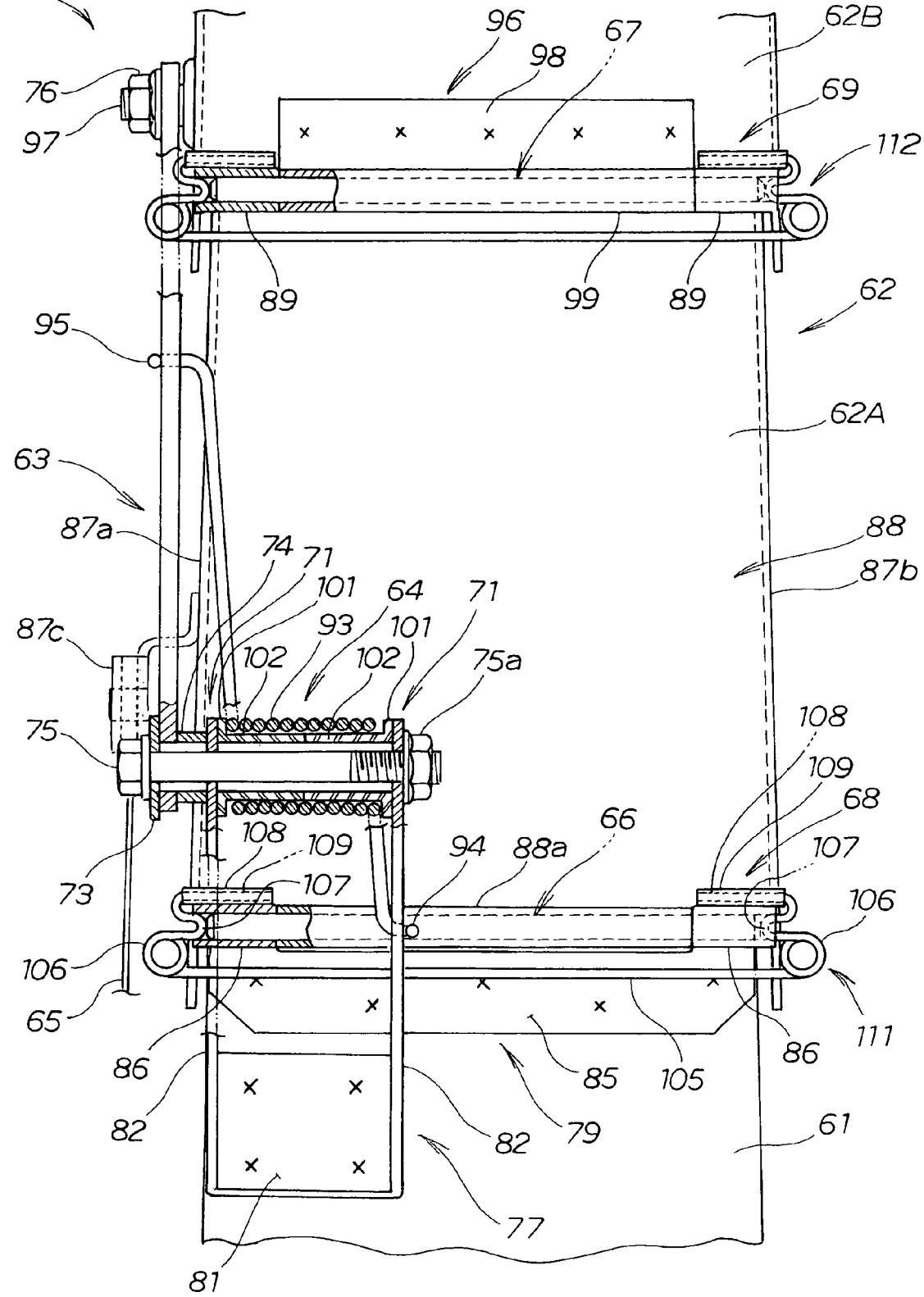
FIG. 8 is an enlarged partial cross-sectional view of the shooter shown in FIG. 4.

As shown in FIG. 8, the shooter 60 of the present invention is designed so that the torsion spring 64 located between the shooter main body 61 side and the shooter guide 62 side is used as a means for returning the shooter guide 62, and the collars (vibration-reducing members) 71, 71 are inserted into the coil 93. This reduces vibration in the torsion spring 64, and suppresses resonance in the torsion spring 64 that occurs with vibration in the engine 13 of the snow remover 10 shown in FIG. 1.

The coil 93 of the torsion spring 64 is located between the left- and right-side parts 82, 82 of the bracket 77. The torsion spring 64 is mounted on the bracket 77 by passing the collars (vibration-reducing members) 71, 71 through the left- and right-side parts 82, 82 and inserting the collars into the coil 93, as was previously described. Therefore, vibration (resonance) and deformation in the radial direction of the torsion spring 64 are prevented.

As described above, the first hinge 111 is composed of a hinge half 79 on the side of the shooter main body mounted on the top end of the shooter main body 61, a hinge half 88*a* disposed on the side of the shooter guide and formed on the bottom end of the first shooter guide 62A, a pin member 66 that rotatably links the hinge half 88*a* on the side of the shooter guide to the hinge half 79 on the side of the shooter main body, and an interlocking member that prevents the pin member 66 from falling out from the hinge half on the side of the shooter main body and the hinge half 88*a* on the side of the shooter guide.

The interlocking member 68 includes a rectilinear part 105 positioned on the side of the shooter main body 61, coils 106, 106 formed at the ends of the rectilinear part 105, and pressure parts 107, 107 that are caused to apply pressure to the ends 66*a*, 66*a* of the pin member 66 by being formed into substantial U shapes so as to protrude from one end of the coils 106, 106 towards the middle of the rectilinear part 105.

Thus, the first hinge 111 has an interlocking member 68. Therefore, the pin member 66 does not fall out from the hinge half 79 on the side of the shooter main body or the hinge half 88*a* on the side of the shooter guide, and maintenance is simplified.

Since the interlocking member 68 has elasticity due to the presence of the coils 106, 106, the interlocking member can easily be attached and detached from the first hinge 111 while the ends 66*a*, 66*a* of the pin member 66 are pressed on by the pressure parts 107, 107.

Next, the manner in which the interlocking member 68 is mounted on the first hinge 111 will be described with reference to FIGS. 9A and 9B.

Figure 9A:
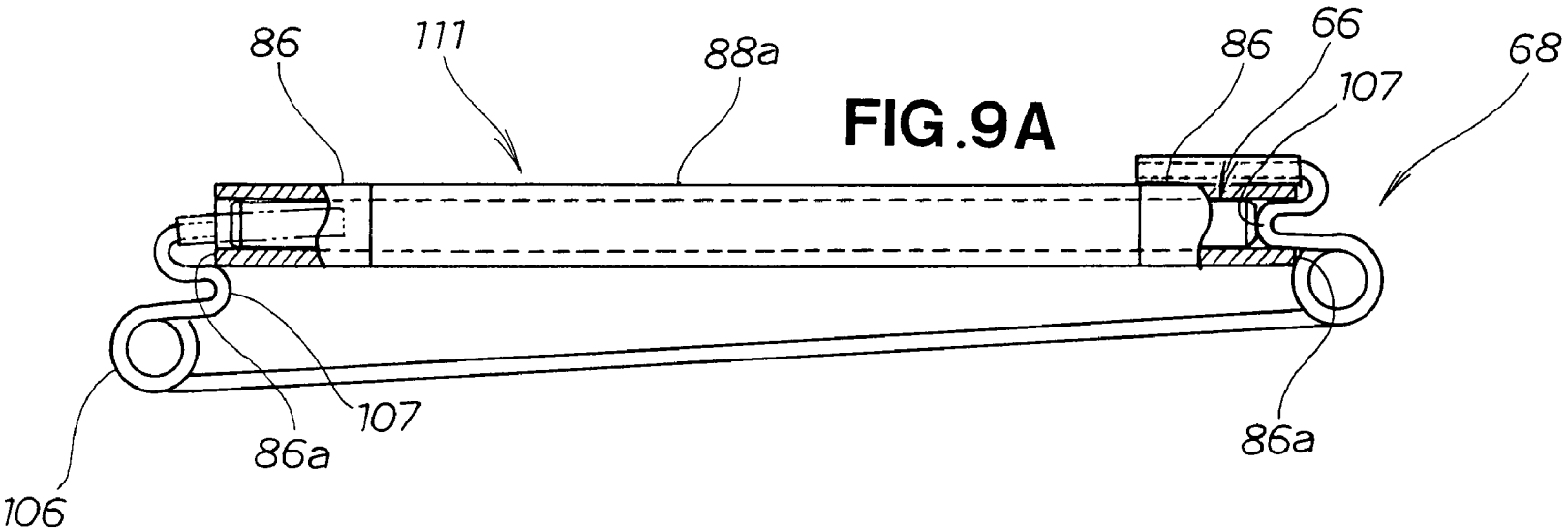
FIGS. 9A and 9B are diagrams showing the manner in which the interlocking member is mounted on the first hinge.

As shown in FIG. 9A, first, the pressure part 107 of the interlocking member 68 is fitted into one end 86*a* of an external tubular part 86, and one end 66*a* of the pin member 66 is pressed on by the pressure part 107. Next, the elasticity of the coils 106 of the interlocking member 68 is used to fit the other pressure part 107 of the interlocking member 68 into the other end of the other external tubular part 86.

Figure 9B:
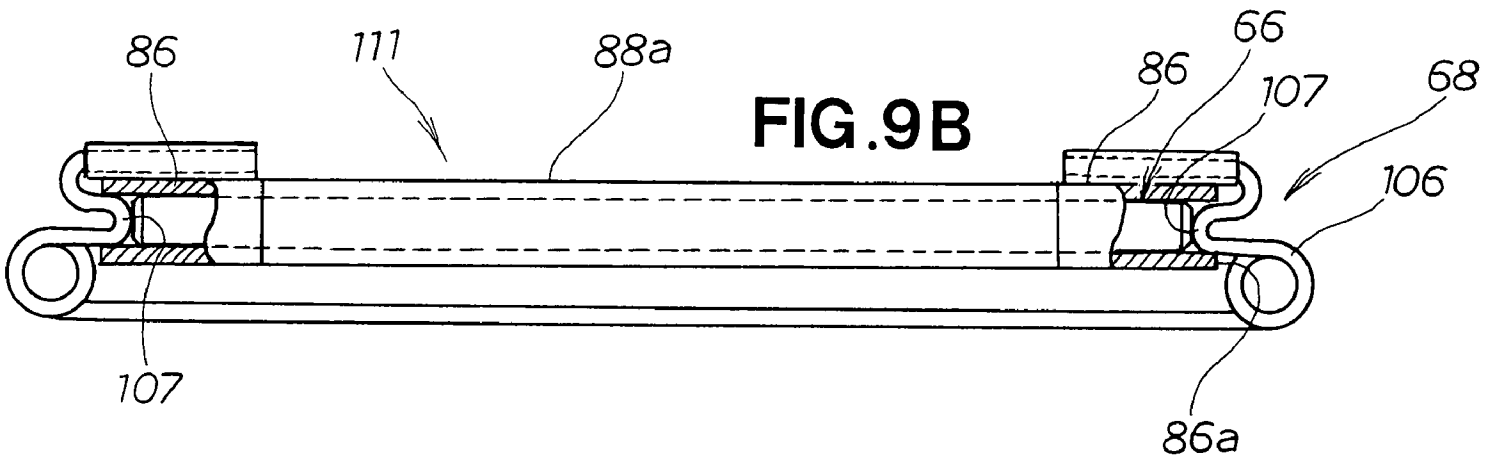
Figure 10:
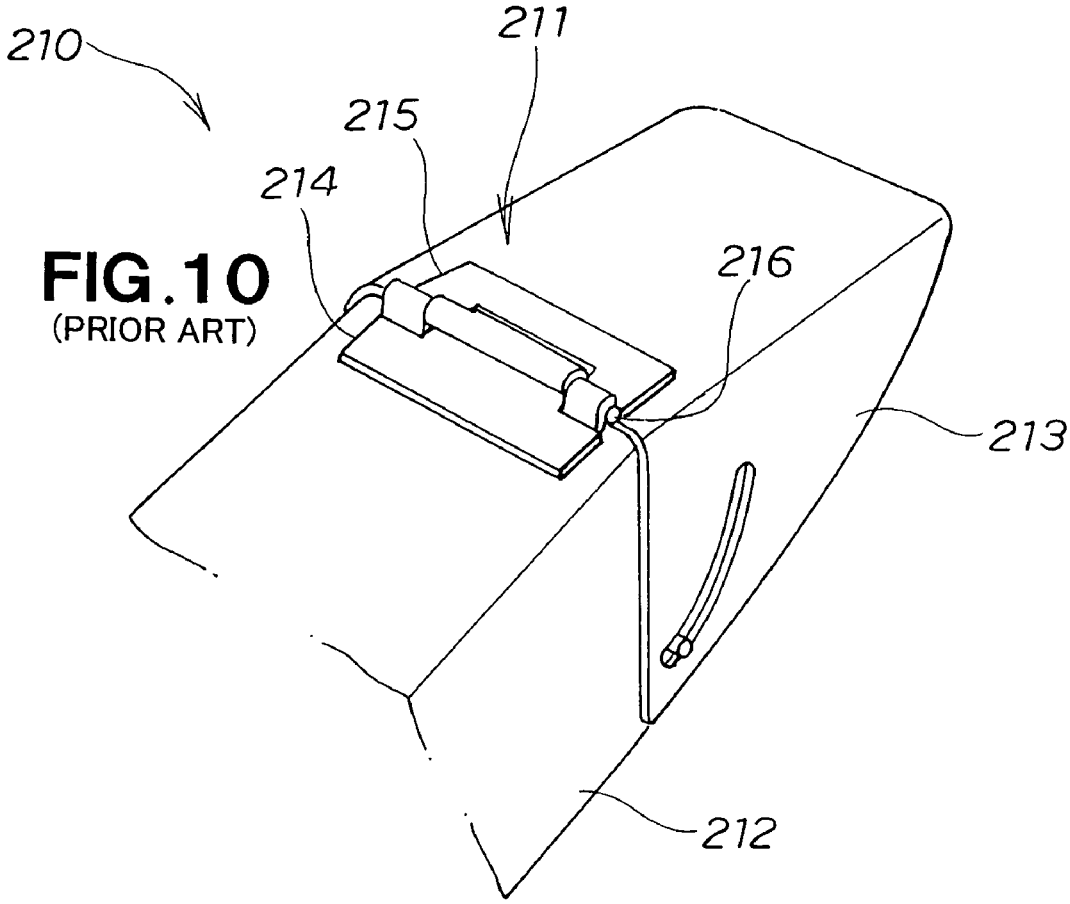
FIG.10 (PRIOR ART)
FIG. 10 is a perspective view of a conventional shooter.

As shown in FIG. 9B, the interlocking member 68 is mounted in the first hinge 111, and the pin member 66 is secured by the pressure parts 107, 107 and does not fall out even if an attempt is made to pull the pin member 66 out from the external tubular parts 86, 86 and the central tubular part 88*a*.

In the present embodiment, an example was given in which the external tubular parts 86, 86 were provided on the side of the shooter main body 61, and the central tubular part 88*a* was formed on the first shooter guide 62A as shown in FIG. 5. However, the present invention is not limited to this embodiment alone, and another possibility is to provide the external tubular parts 86, 86 and the central tubular part 88*a* in their opposite positions. Furthermore, the number of external tubular parts and central tubular parts can be varied appropriately.

In the present invention, the first hinge 111 was described in detail as an example, and the second hinge 112 has the same configuration as the first hinge 111, as shown in FIG. 5.

Obviously, various minor changes and modifications of the present invention are possible in light of the above teaching. It is therefore to be understood that within the scope of the appended claims the invention may be practiced otherwise than as specifically described.

What is claimed is:

1. A shooter for a snow remover, comprising:

a shooter main body, designed to be rotatably mounted on an auger housing of a snow remover, for ejecting to a significant distance snow collected by an auger of the snow remover; and a shooter guide, swingably mounted on a top end of the shooter main body by means of a hinge, for varying an angle of snow projection, wherein the hinge comprises:

a hinge half disposed on a side of the shooter main body and mounted on the top end of the shooter main body;

a hinge half disposed on a side of the shooter guide and formed on a bottom end of the shooter guide;

a pin member inserted through the hinge half on the side of the shooter main body and the hinge half on the side of the shooter guide and rotatably linking the two hinge halves; and an interlocking member for preventing the pin member from falling out from the hinge half on the side of the shooter main body and the hinge half on the side of the shooter guide, and wherein the interlocking member is formed from a wire material, possesses spring properties, and comprises:

a rectilinear part positioned on the side of the shooter main body or the side of the shooter guide;

coiled parts formed at ends of the rectilinear part; and pressure parts each formed into a U-shape so as to protrude towards a center of the rectilinear part, wherein the interlocking member is mounted to the hinge by each pressure part extending into a respective end of the hinge to press against an end of the pin member.

2. The shooter of claim 1, wherein the interlocking member further comprises contact parts formed so as to extend further towards the center of the rectilinear part from one end of the pressure parts so that the contact parts cover a gap formed at a position in which the shooter main body and the shooter guide face each other.

3. The shooter of claim 2, wherein the contact parts comprise gap filling members for covering the gap.

4. The shooter of claim 1, wherein the pin member has a length less than a combined length of the hinge half on the side of the shooter main body and the hinge half on the side of the shooter guide.

* * * * *